US007387207B2

(12) United States Patent
Priebe et al.

(10) Patent No.: US 7,387,207 B2
(45) Date of Patent: Jun. 17, 2008

(54) DETACHABLE PILL CONTAINER

(75) Inventors: Robert N. Priebe, Bloomington, MN (US); Terrance O. Noble, Burnsville, MN (US)

(73) Assignee: Apothecary Products, Inc., Burnsville, MN (US)

( * ) Notice: Subject to any disclaimer, the term of this patent is extended or adjusted under 35 U.S.C. 154(b) by 236 days.

(21) Appl. No.: 10/969,821

(22) Filed: Oct. 21, 2004

(65) Prior Publication Data

US 2006/0086641 A1 Apr. 27, 2006

(51) Int. Cl.
*B65D 83/04* (2006.01)

(52) U.S. Cl. ..... 206/532; 206/538; 206/561; 220/23.4; 220/524

(58) Field of Classification Search ..... 206/528, 206/530, 532, 538, 539, 561, 1.5; 220/23.4, 220/4.21, 4.28, 23.2, 23.83, 524
See application file for complete search history.

(56) References Cited

U.S. PATENT DOCUMENTS 3,131,829 A * 5/1964 Masser ..... 220/23.4
4,372,445 A * 2/1983 Keffeler ..... 206/532
4,770,297 A * 9/1988 Chang ..... 220/23.4
4,793,492 A * 12/1988 Halbich ..... 220/23.4
4,889,254 A * 12/1989 Vola ..... 220/23.4
6,102,232 A * 8/2000 Lin et al. ..... 220/23.4

OTHER PUBLICATIONS

Apex Medical Corporation Twice-a-Day Weekly Pill Organizer, Item No. 70059, Exhibits A1-A4, 4 pages, available prior to Oct. 21, 2004.

* cited by examiner

*Primary Examiner*—Luan K Bui
(74) *Attorney, Agent, or Firm*—Merchant & Gould P.C.

(57) ABSTRACT

A pill container assembly that includes first and second main body members each defining a plurality of separate compartments and having at least one locking feature. The at least one locking features of the first and second main body members are configured to lock to each other with a twist lock connection thereby coupling the first and second main body members together.

17 Claims, 3 Drawing Sheets

DETACHABLE PILL CONTAINER

BACKGROUND OF THE INVENTION

1. Field of the Invention

The present invention relates generally to pill containers, and more specifically relates to a pill container having storage compartments that are removably attached to each other.

2. Related Art

A pill container that is easy to use and has sufficient capacity for a patient's pills increases the likelihood that the user will take the correct medicine at the correct time. Many known pill containers have a fixed capacity defined by a predetermined number of individual compartments. The compartments may have individual lids, or a single lid may be used to provide access to all of the compartments. The number of compartments may correlate with the number of days in a week or with certain times during a single day in which medications stored in the pill container are to be taken by the patient. Most pill containers have a fixed number of compartments. In many cases, the fixed number of compartments and overall storage capacity of a pill container limit the number of applications for the container.

SUMMARY OF THE INVENTION

The present invention is generally directed to storage containers and more specifically relates to pill containers that can be connected to other pill containers. One aspect of the invention relates to a pill container assembly that includes first and second main body members that each define a plurality of separate compartments having an open top, a lid member for each of the compartments, first and second locking protrusions, and first and second locking recesses. The first locking protrusion is formed on an outer surface of the first main body and the first locking recess is formed in an outer surface of the first main body. The second locking protrusion is formed on an outer surface of the second main body and the second locking recess is formed in an outer surface of the first main body. The first locking protrusion and the second locking recess are configured to engage each other, and the first recess and the second locking protrusion are configured to engage each other to lock the first and second main bodies together.

Another aspect of the invention relates to a pill container assembly that includes first and second main body members each defining a plurality of separate compartments and having at least one locking feature. The at least one locking feature of the first and second main body member are configured to lock to each other with a twist lock connection.

Another aspect of the invention relates to a method of assembling a pill container that includes first and second main body members that each define a plurality of compartments having an open top and including at least one locking feature. The method includes aligning the locking features of the first and second main body members, and rotating the first and second main body members relative to each other to couple together the locking features of the first and second main body members.

The above summary of the present invention is not intended to describe each disclosed embodiment or every implementation of the present invention. Other fields may be applicable to fulfill the purposes and intents of the present invention. Figures in the detailed description that follow more particularly exemplify certain embodiments of the invention. While certain embodiments will be illustrated and describe embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
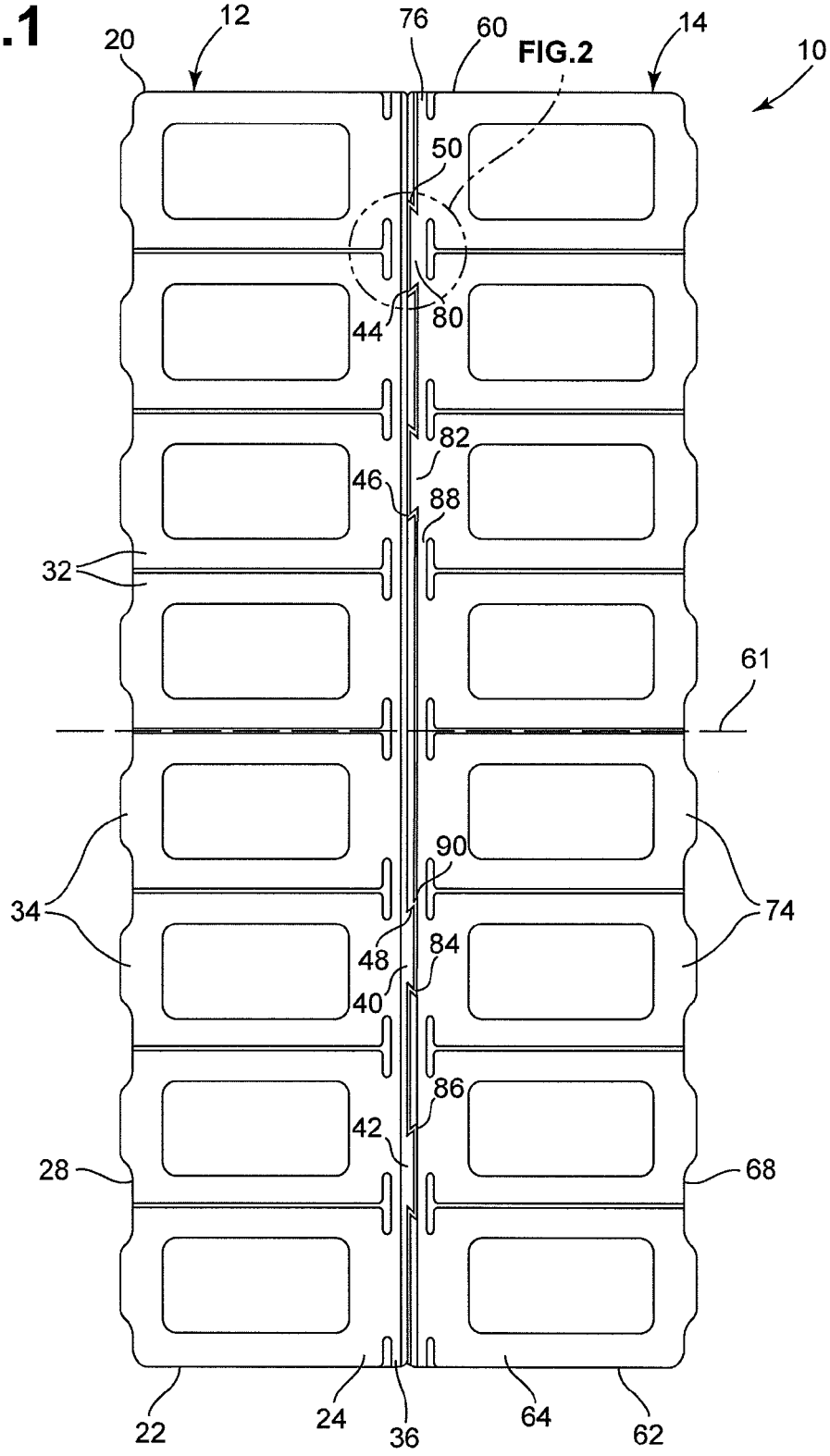
FIG. 1 is top view an example pill container according to principles of the present invention.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention is generally directed to storage containers and more specifically relates to container members than can be removably connected with each other. The container members may include a plurality of compartments and at least one lid member covering and providing access to the compartment volume. By connecting at least two container members together, the net volume provided by the container assembly can be enlarged or otherwise modified to provide a desired amount of container volume, number of container compartments, etc. Thus, different container members having different sizes, shapes, number of compartments may be removably secured together according to principles of the present invention. In this manner, a patient may be able to obtain a customized container assembly.

An example detachable pill container assembly 10 is shown with reference to FIGS. 1-5. Assembly 10 includes first and second container members 12, 14, which may be referred to as main body members. Container members 12, 14 may be substantially identical in size, shape, and configuration of connecting members (described in further detail below) as shown in FIGS. 1-5. In other examples, the container members 12, 14 may have different sizes, shapes, and connecting member configurations while still providing for connection between the two container members 12, 14.

First container member 12 includes first and second ends 20, 22, a top 24, a bottom 26, and front and rear sides 28, 30. Container member 12 also defines a plurality of compartments 32 having openings (not shown) along the top 24 that are accessible via a plurality of lid members 34. The lid members 34 are connected together via a lid connecting member 36 positioned between the compartments 32 and the rear side 30. The lid members 34 are configured for individual opening and closing to provide access to individual compartments 32. In other embodiments, the lid members 34 may be coupled together as a single lid that opens and closes as a single unit. The container member 12 may be shaped so as to provide the compartments 32 with any desired shape and size, such as the generally contoured surface along the bottom 26 and front 28 shown in the Figures. Such a contoured surface improves easy in removing contents from the compartments such as, for example, pills or other relatively small objects retained in the compartments 32.

Figure 4:
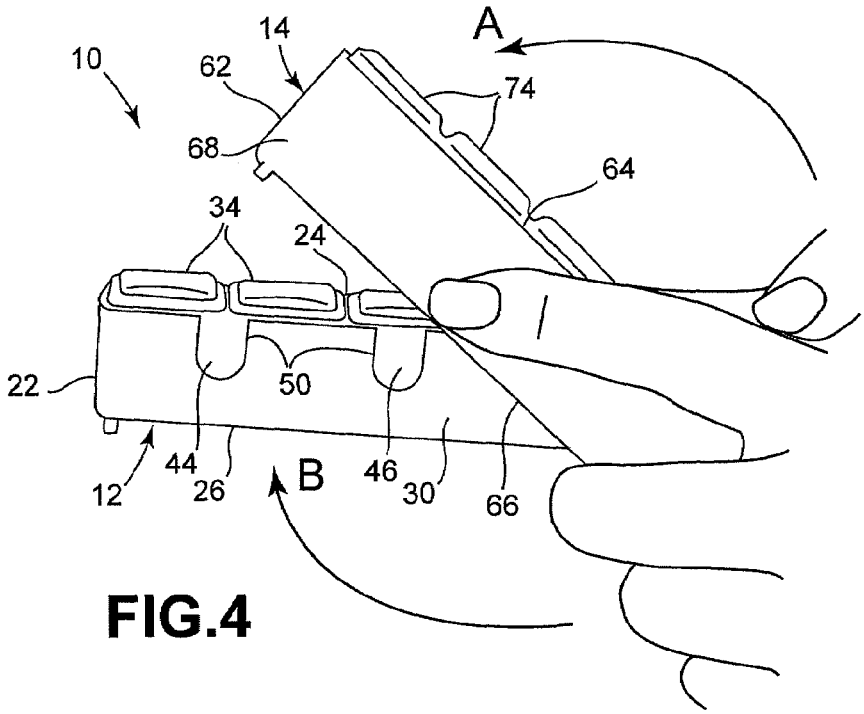
FIG. 4 is a perspective view of the two container portions shown in FIG. 3 being rotated relative to each other towards a locked position.
Figure 3:
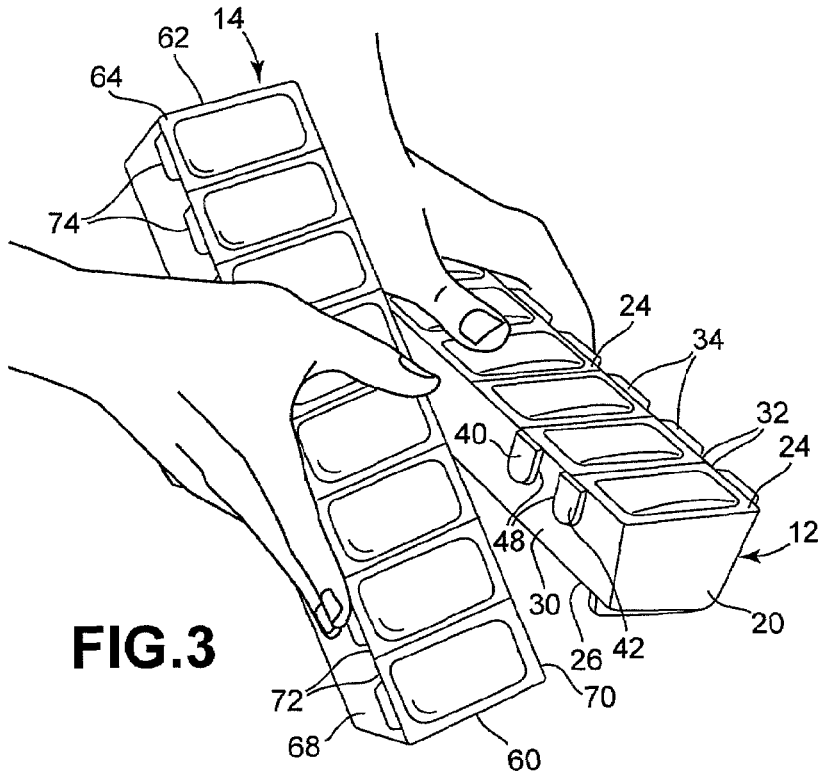
FIG. 3 is a perspective view of two container portions of the pill container shown in FIG. 1 in rotated positions relative to each other.

The first container member 12 also includes first and second locking protrusions 40, 42 and first and second locking recesses 44, 46 positioned along the rear side 30 (see FIGS. 3 and 4). The protrusions and recesses 40, 42 and 44, 46 are positioned as spaced apart pairs on opposing sides of the container 12. The protrusions and recesses 40, 42 and 44, 46 are also aligned with one edge of those features along the top 24. The protrusions and recesses 40, 42 and 44, 46 also include tapered sidewalls 48, 50, respectively. The taper angle of the sidewalls 48, 50 may be substantially similar (see, for example, FIG. 2) to provide improved mating between the protrusions and recesses 40, 42 and 44, 46 to retain the container members together. The locking protrusions 40, 42 include a generally hemispherical shape along a bottom edge facing towards bottom 26. This contoured shape improves alignment between each protrusion and a corresponding recess when mating the protrusion and the recess together.

The second container member 14 includes first and second ends 60, 62, a top 64, a bottom 66, and front and rear sides 68, 70. The container member 14 also includes a plurality of compartments 72, a plurality of lid members 74, and a lid connecting member 76 to which the lid members 74 are coupled. The second container member 14 also includes third and fourth locking protrusions 80, 82, third and fourth locking recesses 84, 86, and tapered sidewalls 88, 90 for the respective protrusions 80, 82 and locking recesses 84, 86. Although FIGS. 1-5 do not provide a complete view of the shape and size of the protrusions 80, 82 and recesses 84, 86, it is to be understood that the protrusions and recesses 80, 82 and 84, 86 may be sized and shaped similar to protrusions 40, 42 and recesses 44, 46 of first container member 12 (as shown in FIGS. 3 and 4). The second container member 14 is configured such that the protrusions 80, 82 mate with the locking recesses 40, 46 of the first container member 12, and the locking recesses 84, 86 mate with the locking protrusions 40, 42 of first container member 12.

Figure 5:
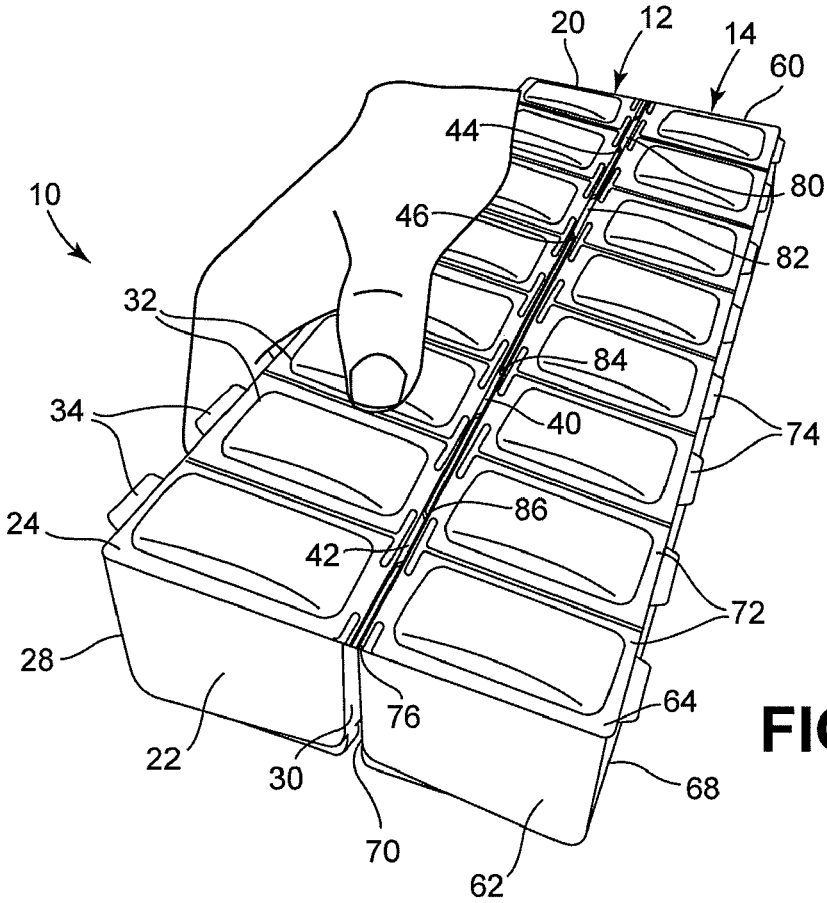
FIG. 5 is a perspective view of the two container portions shown in FIG. 4 connected together in a twist lock arrangement.
Figure 2:
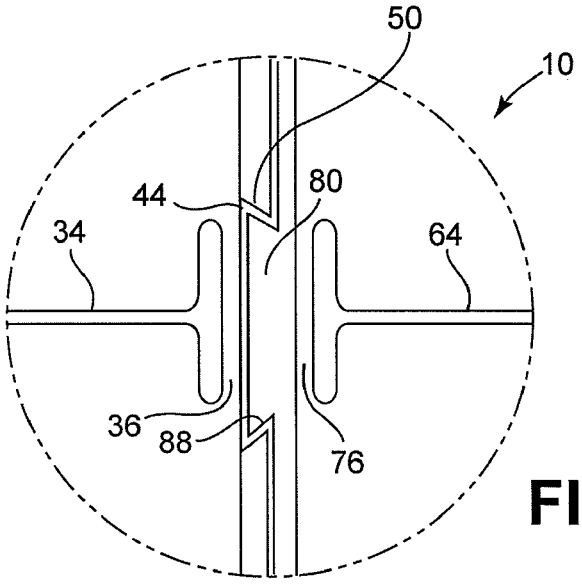
FIG. 2 is a close up detail view of some connecting features of the pill container shown in FIG. 1.

Referring now to FIGS. 3-5, the first and second container members 12, 14 may be secured together with a twist lock connection according to the following steps. The container members 12, 14 are arranged with the rear sides 30, 70 facing each other and second container member 14 is moved into a rotated position in the direction B (see FIG. 4) relative to first container member 12. The first and second container members 12, 14 may be aligned along and rotated relative to a shared centerline 61 (see FIG. 1). The rear sides 30, 70 are then brought into contact with each other, the second container member 14 is rotated in the direction A (see FIG. 4) relative to the first container member 12 until the first and second locking protrusions 40, 42 engage the third and fourth locking recesses 84, 86, and the third and fourth locking protrusions 80, 82 engage and lock with the first and second locking recesses 44, 46. FIG. 5 illustrates the first and second container members 12, 14 secured together in the twist lock arrangement described above.

In alternative embodiments, each of the first and second container members may include only a single locking protrusion and locking recess or may include three or more locking protrusions and locking recesses. In some embodiments, a locking protrusions and a locking recess may be positioned together as a pair rather than the pairs of locking protrusions and locking recesses shown in FIGS. 1-5. In further embodiments, the locking protrusions and locking recesses may be formed on other surfaces besides the rear sides 30, 70. For example, the protrusions and recesses may be formed on surfaces of the ends 20, 22 or 60, 62, or on the bottom surfaces 26, 66. In still further embodiments, the container assembly 10 in the connected state as shown in FIGS. 1 and 5 may be coupled to third container member or second container assembly includes two or more container members. Such a coupling may include a twist lock connection using protrusions and recesses or any other desired connection configuration so as to provide a desired number of container compartments.

The shape and size of the locking protrusions and recesses shown in FIGS. 1-5 may be particularly conducive to molding techniques. In one embodiment, the container members 12, 14 comprise a polymer base material. Polymer base materials may be well suited for molding processes such as injection, compression, vacuum, or casting processes. Molding processes may also be well suited for forming negative surfaces such as the tapered sidewalls 48, 50 and 88, 90. Polymer materials are also well suited for coloring if it is desired to provide certain features of the container members with a certain color.

In other embodiments, the locking protrusions may be separately formed and coupled to the rear sides of the container member using any known connecting methods such as, for example, adhesives. The locking recesses may also be formed in a separate step from formation of the other container member features. In one example, the locking recesses may be formed by milling or otherwise removing material from the rear side of the container member thus forming a recess having a desired shape and size that matches with a corresponding locking protrusion of a separate container member. In still further embodiments, the rear side of the container member may be separately formed as a single piece with the locking protrusion and locking recess features formed therein and then the rear side is later coupled to the remaining container member features. In a still further embodiment, the locking recesses and locking protrusions may be made of a different material from the remaining container member features and then co-molded with the container member.

The nature of the twist lock connection described herein may provide certain advantages related to the relative ease in connecting and disconnecting two container members from each other. A connection involving a twisting action rather than a purely translational/linear motion between two objects allows a user (a person connecting or disconnecting two container members) to apply a torsional force with a lever action. As shown with reference to FIGS. 3 and 4, a user grasping the first and second container members 12, 14 with separate hands can move their hands along the length of each of the first and second container members to an optimum point for applying the greatest torsional force, which may relate to a length of the lever or that portion of the container member where the hand is grasped and the connection point between a connecting recess and locking protrusion. The ability to apply a maximum torsional force may be enhanced by the inherent rigidity of the container members. The materials and structure of the container members may provide rigidity of the container members.

Another advantage related to the example pill container assembly 10 relates to the relative ease in aligning the locking protrusions and locking recesses as part of the twist lock connection between the two container members. By first contacting the rear sides 30, 70, there is an initial contact between the first and second container members that improves the ease of aligning the locking protrusions and locking recesses, such as adjusting the linear position of the first and second container members 12, 14 relative to each other, to more closely align the locking protrusions and locking recesses as the first and second container members 12, 14 are rotated relative to each other.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A pill container assembly, comprising:

first and second main body members each having a top surface, a bottom surface, a rear surface, and a plurality of separate compartments with each compartment having an open top, the open tops accessible along the top surface, the rear surface arranged generally perpendicular to the top surface, and the bottom surface positioned opposite the top surface;

a lid member for each of the compartments, the lid members being secured to one of the first and second main body members with a hinge connection, the hinge connection positioned adjacent the rear surface;

a first locking protrusion positioned on and extending outward from the rear surface of the first main body member, the first locking protrusion having a top end portion oriented toward the top surface and a bottom end portion oriented toward the bottom surface;

a first locking recess defined in the rear surface of the first main body member, the first locking recess having a top end portion open at the top surface and a bottom end portion oriented toward the bottom surface and terminating prior to the bottom surface;

a second locking protrusion positioned on and extending from the rear surface of the second main body member, the second locking protrusion having a top end portion oriented toward the top surface and a bottom end portion oriented toward the bottom surface;

a second locking recess defined in the rear surface of the second main body member, the second locking recess having a top end portion open at the top surface and a bottom end portion oriented toward the bottom surface and terminating prior to the bottom surface;

wherein when the rear surfaces of the first and second main body members are facing each other and rotated relative to each other about an axis oriented perpendicular to the rear surface of the first and second main body members and parallel with the top surface of the first and second main body members, the first locking protrusion is movable within the second locking recess via access into the second locking protrusion through the top end portion of the second locking recess, and the second locking protrusion is movable within the first locking recesses via access into the first locking recess through the top end portion of the first locking recess, and the bottom end portion of the first locking recess engages the bottom end portion of the second locking protrusion to provide a position stop in a first direction from the top surface toward the bottom surface of the first or second main body member, and the bottom end portion of the second locking recess engages the bottom end portion of the first locking protrusion to provide a position stop in the first downward direction.

2. The pill container assembly of claim 1, wherein the bottom end portion of the first and second locking protrusions includes a hemispherical shape, the hemispherical shape promoting engagement of the first and second locking protrusions into the second and first locking recesses, respectively.

3. The pill container assembly of claim 1, wherein the first and second locking protrusions include tapered side walls that mate with tapered side walls of the first and second locking recesses.

4. The pill container assembly of claim 2, wherein the bottom end of the first and second locking recesses includes a hemispherical shape that substantially matches the hemispherical shape of the bottom end of the first and second locking protrusions.

5. A pill container assembly comprising:

first and second main body members each including:

a plurality of compartments having opening arranged along a top surface of the main body member;

a bottom surface arranged opposite the top surface;

a primary mating surface arranged generally perpendicular to the top and bottom surfaces;

at least one locking recess defined in the primary mating surface, the at least one locking recess having first and second opposing ends, the first end being open along the top surface of the main body member and the second end being closed and defining an en engagement surface;

at least one locking protrusion positioned on and extending outward from the primary mating surface, the at least one locking protrusion having first and second opposing ends, the first end of the locking protrusion of the first main body member configured to be inserted into the first end of the locking recess of the second main body member and engage with the engagement surface of the second end of the locking recess of the second main body member to provide a positioned stop for the locking protrusion of the first main body member, and the first end of the locking protrusion of the second main body member configured to be inserted into the first end of the locking recess of the second main body member and engage with the engagement surface of the second end of the locking recess of the first main body member to provide a positioned stop for the locking protrusion of the second main body member;

wherein when the mating surfaces of the first and second main body members are facing each other and rotated relative to each other, the first locking protrusion engages the second locking recess simultaneously with engagement of the second locking protrusion with the first locking recess, and linear motion of the first and second main body members relative to each other in a direction from the top surface to the bottom surface does not provide simultaneous engagement of the locking protrusion and locking recess of the first main body member with the locking recess and the locking protrusion of the second main body member.

6. The pill container assembly of 5, wherein each main body member includes at least two locking protrusions and at least two locking recesses.

7. The pill container assembly of claim 5, wherein the primary mating surface of the first and second main body members are configured to engage each other during engagement of the first and second locking protrusions with the second and first locking recesses, respectively.

8. The pill container assembly of claim 5, wherein the primary mating surface extends from the top surface to the bottom surface.

9. The pill container assembly of claim 5, wherein the locking protrusions and locking recesses of each main body member are integrally formed with the primary mating surface of the respective main body member.

10. A pill container assembly comprising:

first and second main body members each including:

a plurality of compartments;

a top surface, a bottom surface, and a mating surface, the mating surface extending from the top surface to the bottom surface, the mating surface having a height dimension measured from between the top surface and the bottom surface;

at least one locking recess defined in the mating surface, the at least one locking recess having first and second opposing ends, the first end being open at one of the top and bottom surfaces, the second end being closed and defining an engagement surface that acts as a position stop, the at least one locking recess having a length dimension less than the height dimension of the mating surface;

at least one locking protrusion positioned on and extending outward from the mating surface, the at least one locking protrusion having first and second opposing ends, the at least one locking protrusion having a length dimension less than the height dimension of the mating surface;

wherein when the mating surfaces of the first and second main body members are facing each other and rotated relative to each other about an axis arranged perpendicular to the mating surface, the locking protrusion of the first main body member engages within the locking recess of the second main body member simultaneously with engagement of the locking protrusion of the second main body member within the locking recess of the first main body member, and the first end of the locking protrusions enter the locking recesses via the open first end of the locking recesses and engage the engagement surfaces of the closed second ends of the locking recesses to limit relative rotation of the first and second main body members.

11. The pill container assembly of claim 10, wherein the locking protrusions include tapered side walls that mate with tapered side walls of the locking recesses.

12. The pill container assembly of claim 10, wherein each main body member includes at least two locking protrusions and at least two locking recesses.

13. The pill container assembly of claim 10, wherein the mating surface of the first and second main body members are configured to engage each other during engagement of the locking protrusions with the locking recesses.

14. The pill container assembly of claim 10, wherein the plurality of compartments includes an access opening defined in a top surface of the first and second main body members.

15. The pill container assembly of claim 10, wherein the locking protrusions and locking recesses of each main body member are formed integral with the mating surface.

16. The pill container assembly of claim 10, wherein the first end of the locking protrusions includes a hemispherical shape, the hemispherical shape promoting engagement of the locking protrusions with the locking recesses.

17. The pill container assembly of claim 16, wherein the first end of the locking recesses includes a hemispherical shape that substantially matches the hemispherical shape of the locking protrusions.

* * * * *

UNITED STATES PATENT AND TRADEMARK OFFICE

CERTIFICATE OF CORRECTION

PATENT NO. : 7,387,207 B2
APPLICATION NO. : 10/969821
DATED : June 17, 2008
INVENTOR(S) : Priebe et al.

It is certified that error appears in the above-identified patent and that said Letters Patent is hereby corrected as shown below:

Col. 6, line 35, claim 5: "defining an en" should read --defining an--

Signed and Sealed this

Thirtieth Day of December, 2008

JON W. DUDAS
*Director of the United States Patent and Trademark Office*